United States Patent [19]

Wood

[11] 4,036,165

[45] July 19, 1977

[54] PARKING GUIDE

[76] Inventor: Harmin V. Wood, 617 Hanford Place, Westfield, N.J. 07090

[21] Appl. No.: 685,294

[22] Filed: May 11, 1976

[51] Int. Cl.[2] ..... B60Q 1/06; G09F 17/00

[52] U.S. Cl. ..... 116/28 R; 350/97

[58] Field of Search ..... 116/28 R, 2, 4; 33/264; 350/97, 99

[56] References Cited

U.S. PATENT DOCUMENTS

| | | | |
|---|---|---|---|
| 1,981,188 | 11/1934 | Pavitt | 116/28 R |
| 2,693,044 | 11/1954 | Roemisch | 350/97 X |
| 2,834,315 | 5/1958 | Simpson | 116/2 X |
| 3,219,972 | 11/1965 | Williams | 116/28 R X |
| 3,261,321 | 7/1966 | Mandl | 116/28 R |

*Primary Examiner*—Richard C. Queisser

*Assistant Examiner*—Daniel M. Yasich

*Attorney, Agent, or Firm*—Martha G. Pugh

[57] ABSTRACT

A guide to assist a driver to park in an enclosure such as a residential garage. This includes a vertically depending lever which, when contacted by the bumper of the approaching vehicle, simultaneously actuates an audible and a visible signal to apprise the driver of his progress. The audible signal is a bell which is sounded by first cocking and then releasing a spring hammer. The visible signal is a rectangular reflector supported on a shaft which is cam operated to pivot through 90° so that its full face is in front of the driver to indicate proximity to the impending garage wall. The reflector's mounting post also supports a small brightly colored sphere which may be used as a reference to indicate the center of the parking lane to the driver.

6 Claims, 5 Drawing Figures

PARKING GUIDE

BACKGROUND OF THE INVENTION

This relates in general to visible and audible alarms for warning automobile drivers of impending contact with obstacles and, more particularly, to a parking guide for apprising a driver of his position as he approaches a stationary obstacle, such as a curb or garage wall.

A continual problem for automobile drivers is to be able to accurately park their vehicles without damaging the bumpers or fenders by contact with stationary walls or obstacles, such as found in a residential garage, constituting projections or barriers which are ordinarily obscured from the driver's line of sight. Another problem for many drivers is precision parking, such as may be necessitated in an attached residential two-car garage where it is desirable to leave ample aisle space to the rear and sides of the parked car to allow ingress and egress, and access to tools, etc.

A number of prior art systems deal with parking position indicators. However, none of them comprises both visible and audible means for apprising the driver of his parking progress.

SUMMARY OF THE INVENTION

Accordingly, a principal object of the present invention is to provide an improved parking guide. A more particular object is to provide a parking guide, simple to construct and install, for use in a residential garage, which operates both visibly and audibly to apprise the drive of the vehicle's position.

These and other objects are realized in accordance with the present invention in a structure which comprises a parking guide including a vertically depending lever arm (bumper bar) which, when contacted and moved forward by the bumper of an approaching vehicle, simultaneously actuates a first means to strike a bell and a second means to cause a rectangular reflector to pivot on its axis so that its full face is within the driver's line of sight, thereby apprising the driver of the proximity of a stationary obstacle, such as the garage wall. The combination also includes a brightly colored ball disposed in a fixed position, preferably on top of the reflector plate shaft, for the driver to focus on during the parking process.

In a particular embodiment described by way of example, the parking guide is mounted by means of an elbow bracket adjacent the rear wall of a garage, so that the assembly, including the principal plane of the bracket, projects outward about a foot in a plane normal to the wall. The downwardly depending bumper bar is rigidly fastened at its upper end near one edge of a fulcrum lever plate. The latter is pivotted about a pin at its upper corner to rotate in a plane adjacent the face of the bracket. The fulcrum lever plate is shaped to provide upper and lower projecting members directed toward the rear end of the bracket. The rotational excursions of the fulcrum lever plate are guided during activation of the bumper bar by upper and lower lugs projecting from the face of the bracket. A leaf spring, supported by the lower projecting member, rests against an additional lug projecting from the bracket face, which also serves as a stop for a bell clapper support in its rest or cocked position. The latter is mounted to rotate about another pin whenever one end is depressed by the leaf spring, causing the other end to strike a bell fixed to the face of the bracket.

The fulcrum lever plate is sandwiched to move rotatably in the fixed clearance between the bracket on one side and a parallel partial housing plate on the other. The latter supports a pair of vertically aligned bearings in which are mounted a shaft rotatable in a horizontal plane. This supports a brightly colored ball at its upper end which serves as a fixed visible guide in the immediate line of sight of the vehicle driver, which enables him to readily distinguish and focus on the parking guide when moving from bright sunlight into the shade of the garage. Between the upper edge of the bracket and the ball, the rotatable shaft supports a rectangular reflector, preferably diagonally striped, which in the spring-biased rest position of the shaft is in substantial alignment with the bracket. Rigidly fixed to the lower end of the reflector shaft is a tear-shaped cam, which is disposed to be contacted by a wedge-shaped stop fixed to the lower edge of the fulcrum lever plate. As the bumper bar is contacted and deflected by the car bumper, the cam is rotated through a one hundred degree angle by rotation of the fulcrum lever plate, thereby rotating the rectangular reflector plate into fully visible position in the line of sight of the driver.

The present invention has the advantage of simultaneously providing the driver with audio and visual signals and, also, with a fixed ball as a reference to assist him in negotiating a difficult parking operation. The bumper bar preferably has a resilient coating and is readily deflected, providing minimum damage to the vehicle if the indicated position is exceeded. The disclosed combination is simple to manufacture and install.

These and other objects, features and advantages will be apparent from a study of the detailed specification hereinafter with reference to the attached drawings.

DETAILED DESCRIPTION

Figure 1:
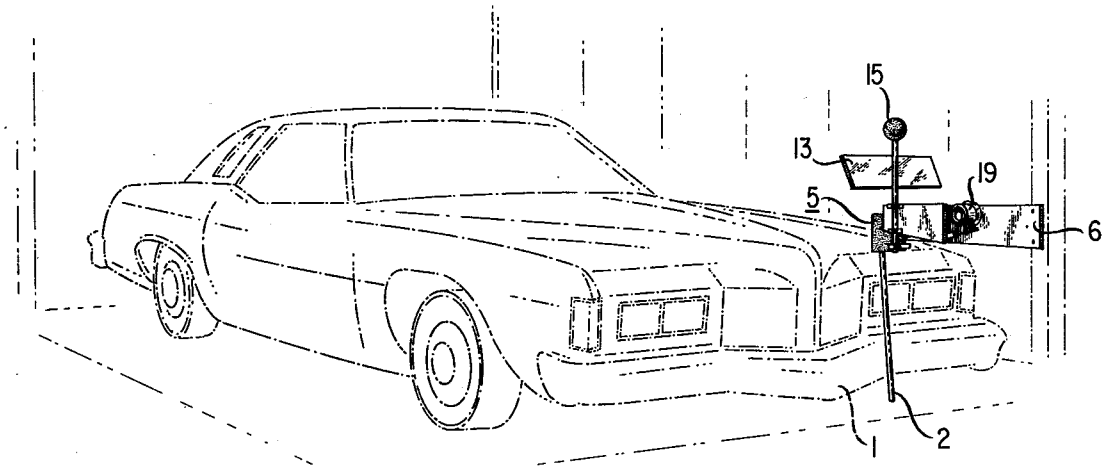
FIG. 1 shows the fully assembled parking guide of my invention in operation after being contacted by an automobile bumper.

Referring to FIG. 1 of the drawings, there is shown a car entering a garage in a conventional manner. The parking guide of the present invention is preferably mounted on a conventional bracket 6, the principal plane of which is parallel to and spaced apart from the side wall of the garage, so that a brightly colored reference ball is visible to the driver, marking the center of the lane. The bracket 6 can either be mounted to the outside edge of a vertical beam projecting laterally from the side wall, as shown in FIG. 1, or directly to the rear wall by means of an elbow bracket. As the car moves to approach the rear of the garage, when its front bumper 1 contacts the bumper bar 2, the latter is deflected towards the rear, causing the following simultaneous actions. A striped reflector plate is rotated from a lateral position to a full planar view directly in front of the car. A bell rings.

Figure 2:
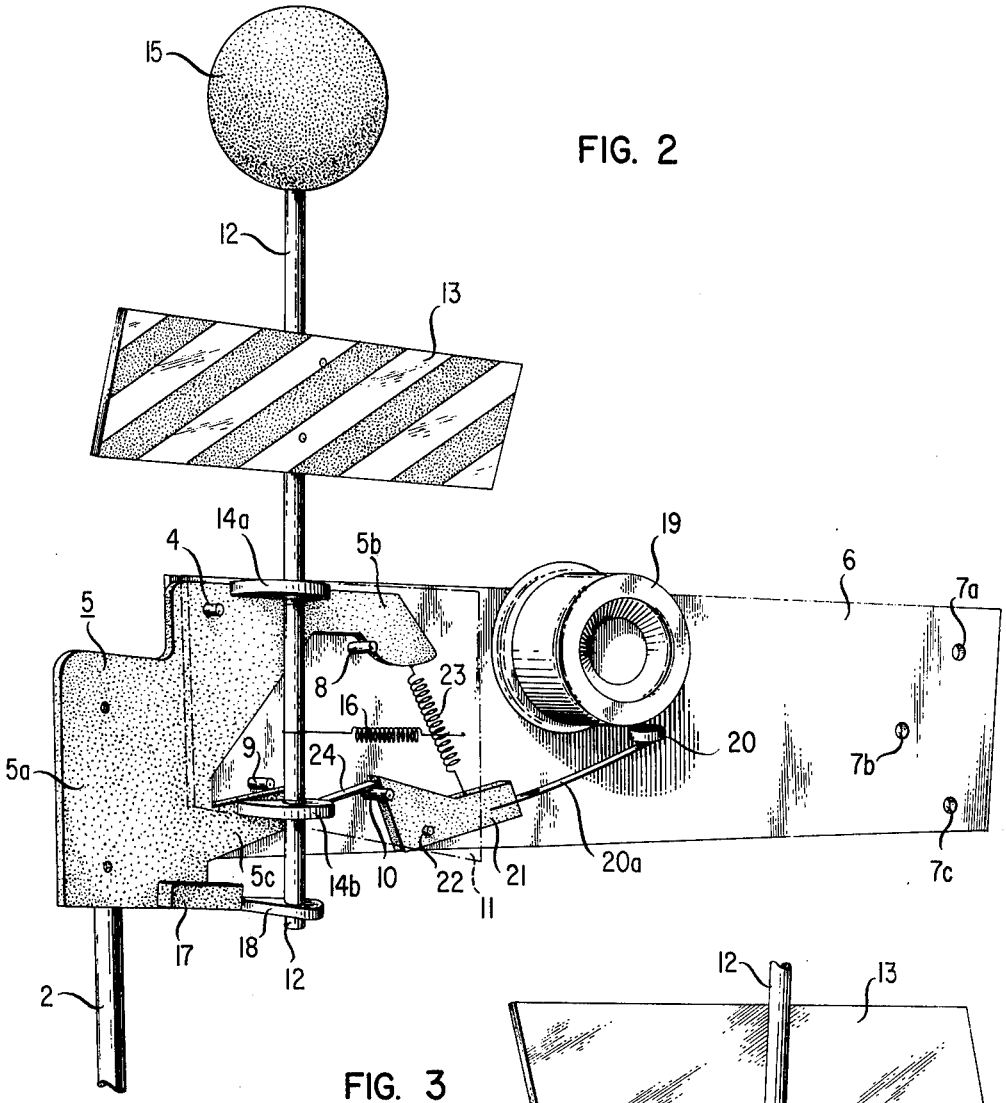
FIG. 2 is an enlarged isometric showing of the mechanism of the parking guide of FIG. 1 in rest position, as viewed from the front right, the partial housing plate having been removed, and the bumper contact bar being shown only in part.

The mechanism for performing these actions is more clearly shown in FIG. 2, from which the lower end of the bumper bar 2 has been removed. Any conventional type rod may serve as bumper bar 2, which is sturdy and of material having sufficient tensile strength and elasticity to prevent its deformation or rupture when contacted by bumper 1. In the embodiment under description, bumper bar 2 comprises an iron or iron-alloy rod three-sixteenths of an inch in diameter, 26 inches long and preferably having a resilient coating of rubber or synthetic rubber, such as neoprene or similar plastic, to protect the finish of the contacted bumper.

Figure 3:
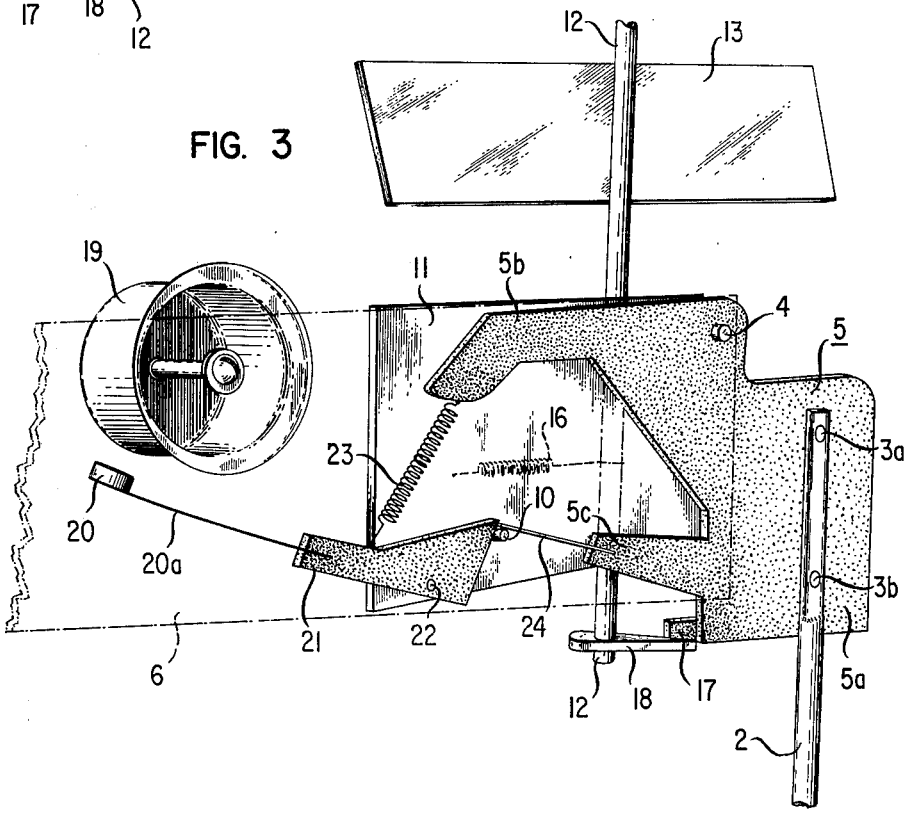
FIG. 3 is an enlarged isometric showing of the mechanism of the parking guide of FIG. 1 in rest position, as viewed from the center left, with the wall bracket shown in phantom, and the bumper bar shown only in part.
Figure 4:
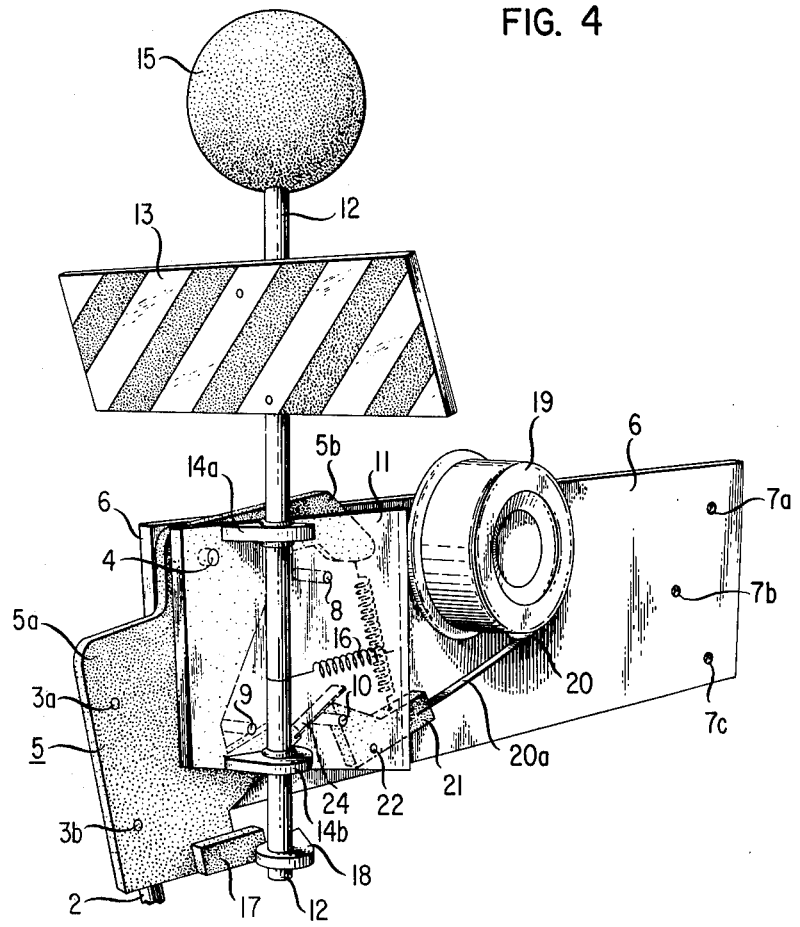
FIG. 4 is an enlarged isometric showing of the mechanism of the parking guide of FIG. 1, as viewed from the right-hand front in operated position, the lower end of the bumper contacting member being removed.
Figure 5:
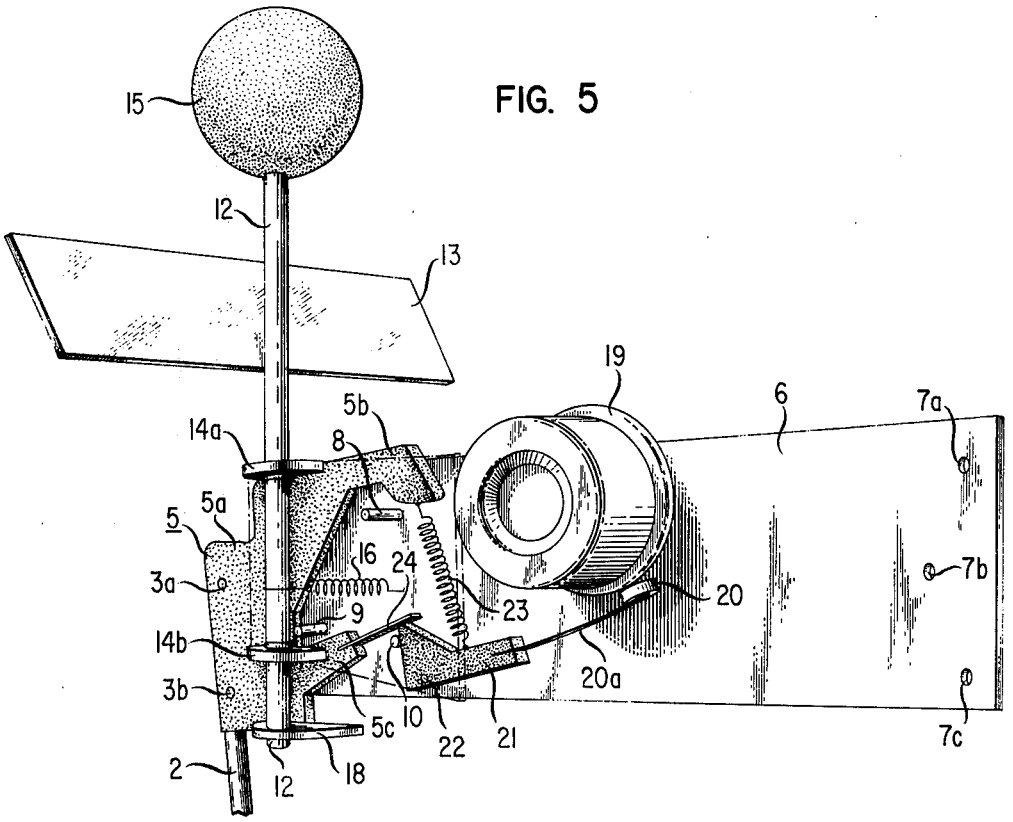
FIG. 5 is an enlarged isometric showing of the mechanism of the parking guide of FIG. 1, as viewed from the right-hand rear, with the housing plate removed to show details of the fulcrum lever plate and assembly on the interior, in operated position.

A portion of the upper end of the bumper bar 2, extending several inches down from the top, is flattened out, being rivetted, screwed or otherwise secured by conventional fastening members 3*a* and 3*b* (see FIG. 3) to a vertical flange 5*a* about one inch wide and three and one-quarter inches high on the front end of the fulcrum lever plate 5, the full outline of which is shown in FIGS. 2 and 3, looking from the right- and left-hand sides, respectively. The fulcrum lever plate 5 may be formed of any suitable rigid material, such as metal, wood or rigid plastic material, such as that known by the trademark PLEXIGLAS (Rohm & Haas Co.), which is used in the present illustrative embodiment.

In FIG. 3, the outline of wall bracket 6, near the front upper corner of which fulcrum lever plate 5 is rotatably fastened, is shown in phantom. The supporting bracket 6, as previously stated, may be fastened to a lateral projection on the side wall of a garage by conventional means, such as rivets or screws 7*a*, 7*b* and 7*c*; or, alternatively, it may comprise an elbow bracket having a rectangular flange similarly fastened to the rear garage wall. The forwardly projecting member of bracket 6 is rectangular, extending forward 12 inches, 3½ inches in a vertical direction and is three-sixteenths of an inch thick. It may be made of any suitable rigid material such as wood, metal or of a sturdy rigid plastic.

The top horizontal edge of fulcrum lever plate 5 extends about seven-eighths of an inch above the upper edge of flange 5*a* and is 2½ inches across the top, being cut out internally so that it forms a finger-shaped member 5*b* which projects downwardly at its end, forming an angle of, say, 45° with the upper edge and extending about seven-eighths of an inch, terminating in a point. The under edge adjacent the point of 5*b* is rounded inwardly and extended tangentially to intersect with a flat plane about five-eighths of an inch long parallel to the top edge, which in turn forms an angle of, say, 135° with the inside edge of the cutout. The latter extends diagonally, intersecting at its inner end a downwardly extending vertical edge.

In its nonrotated rest position, the top edge of fulcrum lever 5 is adjacent to and substantially flush with the top edge of bracket 6. Below the finger 5*b*, the lower periphery of the cutout is bounded by the upper edge of a second projecting finger 5*c* which is, say, five-eighths of an inch above the bottom edge of flange 5*a* and which projects rearward laterally, say, 1¼ inches. The lower edge of finger 5*c* forms an angle of about 120° with a vertical edge and terminates at its rear end in a flat edge five-sixteenths of an inch long, forming an angle of, say, 120° with its upper edge. Fulcrum lever prong 24, comprising a flat leaf spring of stainless steel or the like, is rigidly mounted so that it extends about 1 inch in a direction normal to the end of 5*c*, forming an angle of approximately 30° with a horizontal extension of the lower edge of flange 5*a*. Prong 24 serves to trigger and actuate the bell clapper 20 in a manner which will be described presently.

The fulcrum lever plate 5 is sandwiched into a clearance about five-sixteenths of an inch wide maintained between the bracket 6 and a quadrilateral partial housing plate 11, the principal surface of which is substantially parallel with and spaced apart from the upper front corner of the bracket 6, the upper edge extending parallel thereto for approximately 3½ inches along the top. The lateral edges of partial housing plate 11 are substantially normal to its top edge, the front lateral edge extending down vertically about 2¾ inches, and the rear lateral edge extending down a slightly greater vertical distance, so that the lower edge forms an angle of, say, 30° with the horizontal. The partial housing plate 11 may also be of any rigid material, metal, wood or plastic, such as, for example, PLEXIGLAS, used in the present illustration. Housing plate 11 is three-sixteenths of an inch thick, and is disposed in parallel relation to the inside surface of the bracket 6. Three cylindrical fixed lugs, 8, 9 and 10, having their centers disposed in the form of a triangle with sides respectively equal to, say, two, one and three-eighths, and one and seven-eighths inches, serve to maintain a fixed clearance of, say, five-sixteenths of an inch between the outer surface of the bracket 6 and the inner surface of housing plate 11. Each of these lugs also serves another function.

The lug 8 is disposed to bear on the inside rounded edge of the finger 5*b* in rest position, and acts as a stop to prevent the finger from moving down. When the bumper bar 2 is deflected, fulcrum lever plate 5 is rotated counterclockwise about pin 4 and the projecting finger 5*b* is lifted off of lug 8.

The lug 9, being located in the lower inside portion of the cutout of fulcrum lever 5, bears on the upper surface of projection 5*c*, pressing it down when the lever is in rest position; and lug 9 moves to engage a flat vertical portion at the rear of the cut to arrest the counterclockwise rotation of 5 during deflection of bumper bar 2.

In the rest position of the fulcrum lever plate 5, lug 10 serves as a rest for the free end of the triggering leaf spring 24 before it overrides the upper end of the bell clapper mount 21 to move the bell clapper 20 to strike the bell resonator 19. See FIGS. 2 and 3.

Bell clapper mount 21 may be formed of any suitable rigid material, preferably similar in composition and thickness to that of the fulcrum lever plate 5, such as wood, metal or, in the embodiment under description, plastic, such as, for example, that known by the trademark PLEXIGLAS. Referring to FIG. 2, the left-hand end comprises a broadened foot which rests against the lug 10, taking the shape of the base of a right angle triangle, the apex and being extended to form an oblong. The broadened foot in contact with lug 10 is, say, 1⅝ inches long and the total length at right angles is 1¾ inches, being 1 inch across at the oblong end which supports member 20*a*. Element 21 is mounted near its center to rotate about pin 22 which is fixed between the faces of bracket 6 and partial housing 11. The bell clapper 20 comprises a metal nut or bead fixed to the end of a steel leaf spring 20*a,* which is rigidly mounted in the oblong end of mount 21.

A bell resonator 19, which in the present embodiment may be similar to a conventional bicycle bell, comprises a cylindrical housing 2½ inches in diameter, bolted at its center onto the bracket 6 in a position five-eighths of an inch from the top edge and 5 inches from the front edge, adjacent the rear edge of partial housing plate 11, as shown in FIG. 3. In rest position, bell clapper 20 is spaced about one-quarter of an inch from contact with bell resonator 19.

A coil spring 23, comprising, say, 60 coils of stainless steel wire, is connected between the rounded under end of projection 5*b* and a fastening on the top of the oblong projection of bell clapper mount 21, three-quarters of an inch from the end. Spring 23 serves to bias clapper mount 21 for counterclockwise rotation about pin 22.

Near the upper and lower edges of partial housing 11, disposed with their centers one inch from the outside edge, are a pair of bearings 14*a* and 14*b,* having vertically aligned bores in which are rotatably mounted a vertical shaft 12. The latter is preferably a solid rod of any suitable metal. In the present embodiment, the rod is of aluminum, three-eighths of an inch in diameter and 9½ inches long.

The shaft 12 is topped with a ball 15, which in the present embodiment is an orange hollow plastic sphere, 1¼ inches in diameter, centered 5 inches above the upper edge of the bracket 6.

Disposed transversely with its principal axis normal to the shaft 12, about one inch above the upper edge of bracket 6, is the reflector plate 13. In the present embodiment this is a rectangular sheet or plate of metal, such as aluminum, 4⅝ inches long, 1½ inches wide and three-sixteenths of an inch thick. It may have stripes of reflectorized material disposed in parallel lines diagonally across its face. The centerline of plate 13 is bolted or bracketed onto the shaft 12 so that in the rest position its principal face is aligned with its lower edge, substantially parallel to the upper edge of bracket 6, but with its principal plane tipped forward in a clockwise direction, forming an angle of about 15° with the plane of bracket 6.

Centered about 1⅛ inches below bracket 6 at the lower end of shaft 12 is a tear-shaped cam 18 which is designed to cooperate with the rectangular stop member 17. The latter, which is three-eighths of an inch square in cross-section and fifteen-sixteenths of an inch long and located with its lower edge flush with the lower edge of flange 5*a,* has a wedge-shaped end disposed to contact cam 18 so that it slightly overlaps and bears against the cusp of the tear drop, as shown in FIGS. 2 and 3.

When the bumper bar 2 is deflected, moving fulcrum lever bar 5 in a counterclockwise direction, the rectangular stop 17 is disposed to engage the cusp of the cam 18, rotating the cam and shaft 12, to which it is rigidly connected. As bumper bar 2 moves through a full 6-inch arc, reflector plate 13 moves through approximately 100° in a clockwise direction so that the reflector 13 is disposed in full front view, substantially parallel to and in front of the windshield of the approaching automobile. The bracket 6 is preferably mounted so that reflector 13 is 6 to 8 inches above the hood of the car and, when operated, is in the line of sight of the driver.

Simultaneously, when the bumper bar 2 is moved by contacting bumper 1 through an arc of about 4 or 5 inches, it causes fulcrum lever plate 5 to rotate through a sufficient angle in a counterclockwise direction to raise lower projecting member 5*c,* increasing the angle of the leaf spring 24 relative to the base of bell clapper mount 21. Spring 24 rolls along the top of pin 10, overriding and depressing the end of bell clapper mount 21, causing it to rotate in a counterclockwise direction about pin 22. This moves bell clapper 20 to strike the bell resonator 19, sounding an alarm.

When the fulcrum lever plate 5 returns to rest position, after pressure of the bumper against bumper bar 2 has been removed, the lug 9 moves along the upper edge of the lower projecting member 5*c,* depressing it and causing the leaf spring 24 to retract and come to rest against the lug 10, thereby triggering the bell clapper mount 21 for a subsequent operation. The projecting member 17 releases its pressure on cam 18, causing shaft 12 to return to its rest position against the tension of spring 16 and to return reflector plate 13 to a position substantially parallel to the principal face of bracket 6. Although the shaft-biasing spring 16 is shown laterally extended, it will be understood that in an alternate arrangement it can be coiled around shaft 12. In each case, it is fastened at its lower end to the partial housing plate 11.

Although the invention has been described with reference to a specific type of parking guide, installed adjacent the rear wall of a residential garage, it will be understood that the device can be modified to apply to lateral garage walls, driveways or other types of fixed obstacles which present parking hazards.

It will be understood that the present invention is not limited to the specific combination of elements described, which is merely illustrative, the scope of the invention being defined by the appended claims.

What is claimed is:

1. A parking guide for assisting the driver of a vehicle to avoid contact with a fixed obstacle comprising in combination:

means including a bracket mounted on a support so that its forward end is interposed at a fixed position between the approaching end of said vehicle and said obstacle, a fulcrum lever pivotally mounted on said bracket for partial rotation from a rest position to an operated position in a plane substantially parallel to the plane of said bracket, a vertically extending contact lever responsive to contact by said vehicle and having one end fixed to one side of said fulcrum lever, and the other end depending vertically from said lever for pivotal movement, a bell comprising a resonator and a clapper mounted on the bracket, said clapper disposed to strike said bell in response to movement of said fulcrum lever to the operated position, a reflector plate having an extended surface rotatably mounted on said bracket adjacent the forward end thereof, said reflector plate being spring biased and retained by a first means in a retracted position substantially parallel to said bracket, and said reflector responsive to rotation of said fulcrum lever to assume a fully visible position in the line of vision of said driver, and a second means connected to said fulcrum lever and responsive to deflection of said contact lever by said vehicle to move said fulcrum lever from the rest position to the operated position, initiating the striking of said resonator by said clapper, causing release of said first means and the rotation of said reflector from said retracted position to said fully visible position.

2. The combination in accordance with claim 1 wherein said means for rotating said reflector from said retracted position to said fully visible position comprises:

a vertically extending shaft journalled to rotate in bearing means supported in fixed relationship to said bracket, said reflecting means rigidly fixed to said shaft, a cam connected to rotate with said shaft, and a projection on said fulcrum lever constructed to bear on said cam and to rotate said shaft through a substantial angle in response to a partial rotation of said fulcrum lever.

3. The combination in accordance with claim 2 wherein a fixed indicator comprising a bright colored ball is attached to the top of said shaft, disposed in the line of sight of said driver.

4. The combination in accordance with claim 1 wherein said means connected to said fulcrum lever for initiating the striking of said bell comprises:

upper and lower rearwardly projecting members on said fulcrum lever, a mounting supporting a bell clapper constructed to move pivotally in a plane substantially parallel to the plane of said fulcrum lever, from a first position wherein said bell clapper is in spaced apart relation to said bell resonator to a second position wherein said bell clapper is in contact with said bell resonator, said bell clapper mounting being spring biased to the upper rearwardly projecting member on said fulcrum lever, triggering means including a leaf spring extending from the lower projecting member on said fulcrum lever for maintaining said bell clapper mounting in said first position when said fulcrum lever is in rest position and for releasing said bell clapper mounting to said second position when said fulcrum lever is in the operated position.

5. The combination in accordance with claim 4 which includes three lugs fixed to the principal face of said bracket, a first one of said lugs disposed to bear on an inner edge of the upper rearwardly projecting member of said fulcrum lever to limit the counterclockwise rotation of said fulcrum lever in returning to the rest position relative to said bracket, a second one of said lugs disposed in the rest position of said fulcrum lever to bear on an upper edge of said lower rearwardly-projecting member, and in the operated position of said fulcrum lever to bear on an internal vertical edge of said fulcrum lever between said upper and lower projecting members to limit the rearward excursion of said lower projecting member, a third one of said lugs disposed to engage the under end of the leaf spring comprising said triggering means, and to simultaneously act as a stop for said bell clapper mounting in said first position, whereby when said fulcrum lever is actuated to move from rest to operated position, the leaf spring comprising said triggering means is moved off of said third lug, depressing said bell clapper mounting to said second position causing the bell clapper to strike the bell resonator, and wherein when said fulcrum lever returns to rest position said second lug bears on said lower projecting member, depressing the leaf spring comprising said triggering means against said third lug, triggering said bell clapper mounting for subsequent striking of said bell.

6. The combination in accordance with claim 5 comprising a partial housing plate rigidly supported by said lugs in spaced apart, substantially parallel relation to the face of said bracket, said fulcrum lever being pivotally mounted for rotation in the clearance between said bracket and said partial housing plate, the bearing means for said shaft being mounted in substantially vertically aligned relation on the outer face of said partial housing.

* * * * *

UNITED STATES PATENT AND TRADEMARK OFFICE

CERTIFICATE OF CORRECTION

PATENT NO. : 4,036,165

DATED : July 19, 1977

INVENTOR(S) : Harmin V. Wood

It is certified that error appears in the above-identified patent and that said Letters Patent are hereby corrected as shown below:

Column 1, line 34, change "drive" to --driver--.
Column 4, line 64, change "and" to --end--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*